US006649080B2

(12) United States Patent
Okazaki et al.

(10) Patent No.: US 6,649,080 B2
(45) Date of Patent: Nov. 18, 2003

(54) PHOSPHATE ESTER BASE STOCKS AND AIRCRAFT HYDRAULIC FLUIDS COMPRISING THE SAME

(75) Inventors: Mark E. Okazaki, Alameda, CA (US); Adrian D'Souza, Walnut Creek, CA (US); Shlomo Antika, Maplewood, NJ (US)

(73) Assignees: ExxonMobil Research and Engineering Company, Annandale, NJ (US); Chevron USA, Inc., San Francisco, CA (US)

( * ) Notice: Subject to any disclaimer, the term of this patent is extended or adjusted under 35 U.S.C. 154(b) by 215 days.

(21) Appl. No.: 09/967,264

(22) Filed: Sep. 28, 2001

(65) Prior Publication Data

US 2002/0117648 A1 Aug. 29, 2002

Related U.S. Application Data

(62) Division of application No. 09/425,554, filed on Oct. 22, 1999, now Pat. No. 6,319,423.

(60) Provisional application No. 60/105,503, filed on Oct. 23, 1998, and provisional application No. 60/106,160, filed on Oct. 28, 1998.

(51) Int. Cl.[7] ..... C09K 5/00

(52) U.S. Cl. ..... 252/78.5; 252/75; 252/78.1; 508/440

(58) Field of Search ..... 252/78.5, 78.1, 252/75; 508/440

(56) References Cited

U.S. PATENT DOCUMENTS

| | | | | |
|---|---|---|---|---|
| 3,487,020 | A | 12/1969 | Peeler et al. | 252/78 |
| 3,592,772 | A | 7/1971 | Godfrey et al. | 252/78 |
| 3,679,587 | A | 7/1972 | Smith | 252/75 |
| 3,718,596 | A | 2/1973 | Richard, Jr. | 252/78 |
| 3,723,320 | A | 3/1973 | Herber et al. | 252/78 |
| 3,849,324 | A | 11/1974 | Sheratte | 252/78 |
| 3,907,697 | A | 9/1975 | Burrous | 252/75 |
| 3,931,022 | A | 1/1976 | Chesluk et al. | 252/47.5 |
| 3,941,708 | A | 3/1976 | Gentit et al. | 252/78 |
| 3,983,046 | A | 9/1976 | Sheratte | 252/78.5 |
| 4,206,067 | A | 6/1980 | MacKinnon | 252/75 |
| 4,302,346 | A | 11/1981 | MacKinnon | 252/75 |
| 5,035,824 | A | 7/1991 | MacKinnon | 252/75 |
| 5,205,951 | A | 4/1993 | MacKinnon | 252/78.5 |
| 5,464,551 | A | 11/1995 | Deetman | 252/78.5 |
| 5,817,606 | A | 10/1998 | Kinker et al. | 508/440 |

FOREIGN PATENT DOCUMENTS

| | | | |
|---|---|---|---|
| GB | 1121567 | 7/1968 | C10M/1/46 |
| WO | WO 96/17517 | 6/1996 | A01N/27/00 |

*Primary Examiner*—Yogendra N. Gupta
*Assistant Examiner*—D G Hamlin
(74) *Attorney, Agent, or Firm*—Estelle C. Bakun

(57) ABSTRACT

Disclosed are phosphate ester base fluids and aircraft hydraulic fluids containing a novel combination of phosphate ester components. The disclosed aircraft hydraulic fluids contain from about 30 to about 45 weight percent, based on the total weight of the fluid, of tri-iso-butyl phosphate; from about 30 to about 45 weight percent, based on the total weight of the fluid, of tri-n-butyl phosphate; from about 10 to about 15 weight percent, based on the total weight of the fluid, of one or more triaryl phosphates; and an effective amount of a viscosity index improver, an acid control additive and an erosion inhibitor.

9 Claims, 7 Drawing Sheets

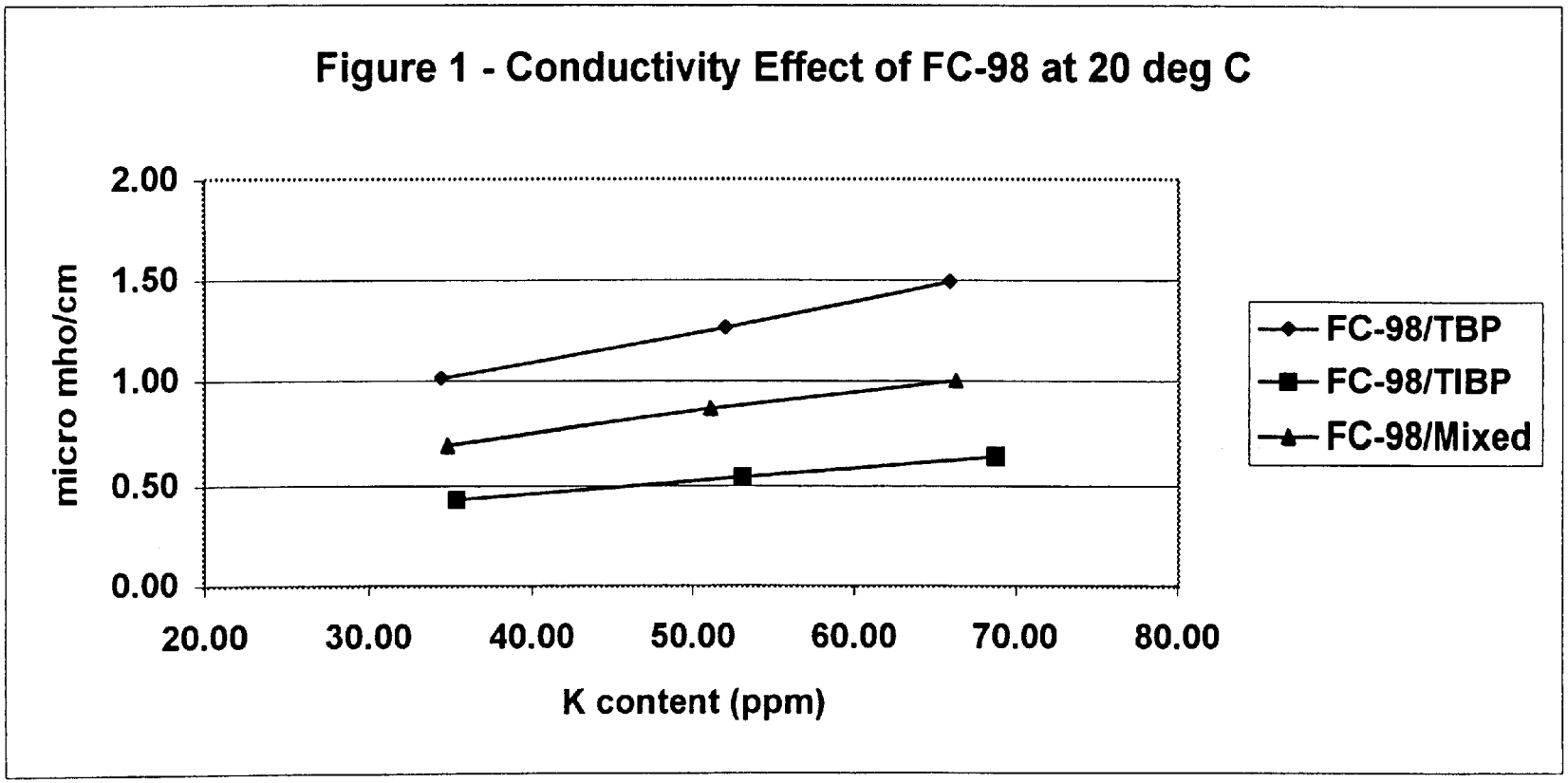
Figure 1 - Conductivity Effect of FC-98 at 20 deg C
FC-98/TBP
FC-98/TIBP
FC-98/Mixed
micro mho/cm
2.00
1.50
1.00
0.50
0.00
20.00
30.00
40.00
50.00
60.00
70.00
80.00
K content (ppm)

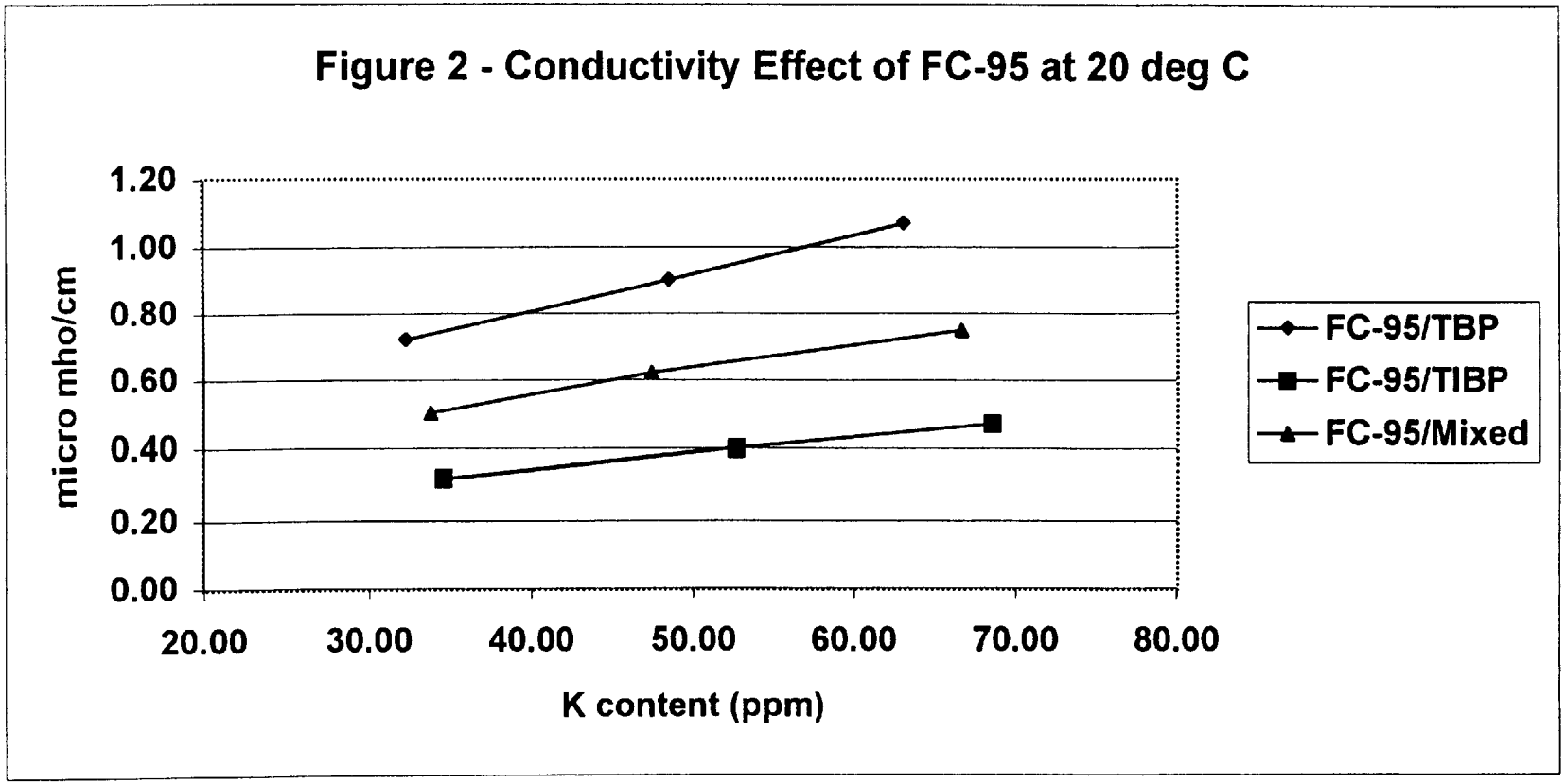
Figure 2 - Conductivity Effect of FC-95 at 20 deg C
micro mho/cm
1.20
1.00
0.80
0.60
0.40
0.20
0.00
20.00
30.00
40.00
50.00
60.00
70.00
80.00
K content (ppm)
FC-95/TBP
FC-95/TIBP
FC-95/Mixed FC-95
FC-98
Conductivity at 20 deg F
1.5
1
0.5
0
0
20
40
60
80
100
Percent TIBP Effect of TIBP on Wear
Wear Scar (mm)
1
0.95
0.9
0.85
0.8
0.75
0
20
40
60
80
100
% TIBP in (TBP+TIBP)

Effect of TIBP on Elastomer Swell
% Elastomer Swell
25
20
15
0
20
40
60
80
100
% TIBP in (TBP+TIBP)

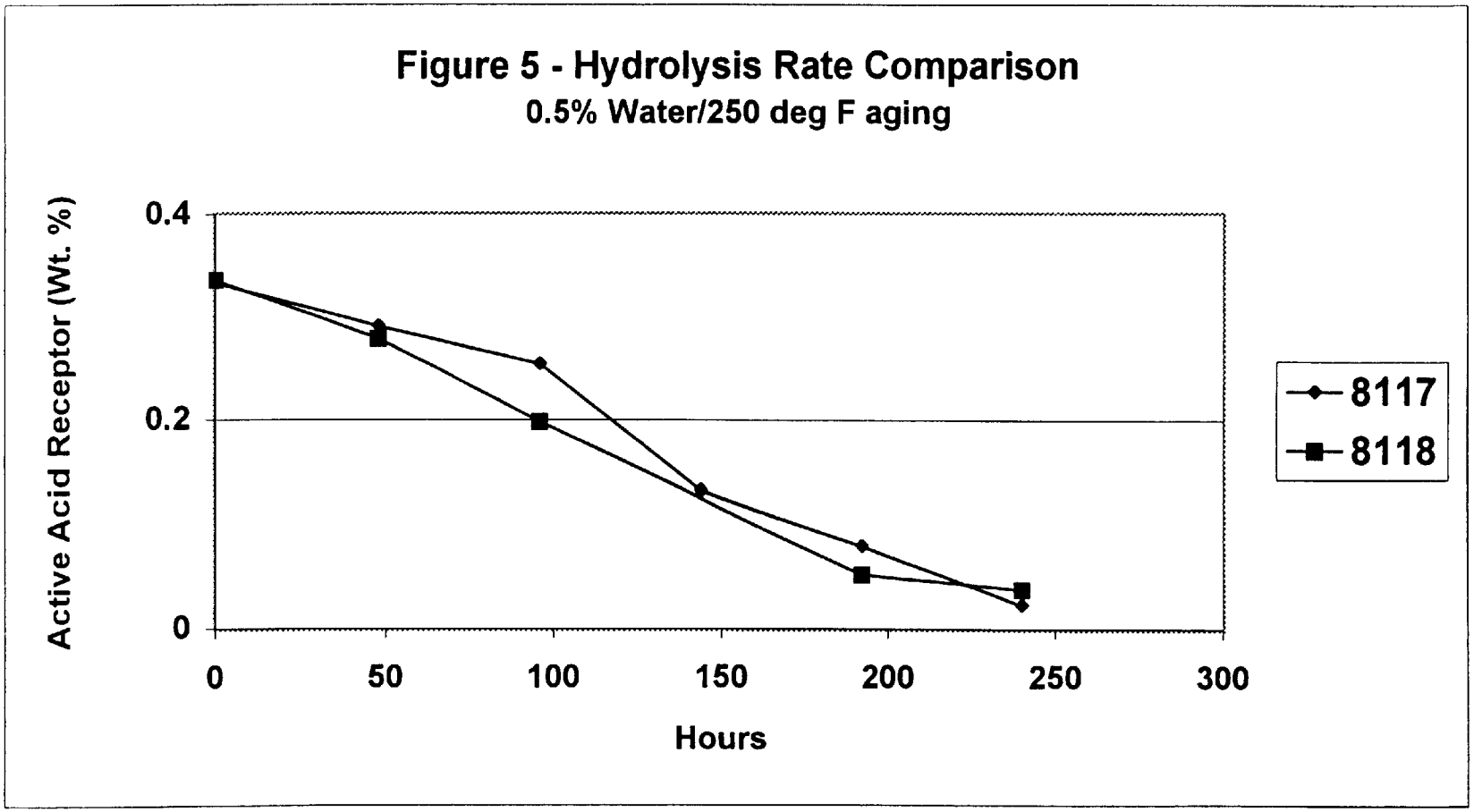
Figure 5 - Hydrolysis Rate Comparison
0.5% Water/250 deg F aging
Active Acid Receptor (Wt. %)
0.4
0.2
0
0
50
100
150
200
250
300
Hours
8117
8118

PHOSPHATE ESTER BASE STOCKS AND AIRCRAFT HYDRAULIC FLUIDS COMPRISING THE SAME

CROSS-REFERENCE TO RELATED APPLICATIONS

This application is a Divisional of Ser. No. 09/425,554 filed Oct. 22, 1999 now U.S. Pat. No. 6,319,423 and, claims the benefit of U.S. Ser. No. 60/105,503, filed Oct. 23, 1998, and U.S. Ser. No. 60/106,160, filed Oct. 28, 1998, the disclosures of which are incorporated herein by reference in their entirety.

BACKGROUND OF THE INVENTION

1. Field of the Invention

This invention relates to phosphate ester base stock compositions having a novel combination of phosphate ester components and to aircraft hydraulic fluid compositions comprising such base stocks.

2. State of the Art

Hydraulic fluids used in the hydraulic systems of aircraft must meet exacting specifications set by aircraft manufacturers. Accordingly, the components of aircraft hydraulic fluids are carefully chosen to balance, among other properties, stability, compatibility, density, toxicity and the like. Whether the selected components can, in fact, be balanced to meet these specifications is unpredictable. Moreover, the amounts of individual components used in compositions which meet the specifications is not a priori predictable.

It has now been discovered that a particular combination of phosphate ester components employed in the base stock of aircraft hydraulic fluid compositions provides surprising and unexpected properties. Specifically, it has been found that by selecting particular ratios of the tri-iso-butyl and tri-n-butyl phosphate ester components of the fluid, an unexpected and surprising balance of combined properties critical to aviation hydraulic oils is obtained, including acceptable hydrolytic stability, high flash point, good anti-wear properties, acceptable erosion protection, acceptable low temperature flow properties (viscosity), and elastomer compatibility.

SUMMARY OF THE INVENTION

This invention is directed to phosphate ester base stock compositions and aircraft hydraulic fluid compositions containing a basestock having a novel combination of phosphate ester components.

Accordingly, in one of its composition aspects, the present invention is directed to an aircraft hydraulic fluid composition comprising a phosphate ester-base stock comprising a mixture of tri-iso-butyl phosphate and tri-n-butyl phosphate and a sufficient amount of one or more triaryl phosphates such that the base stock composition produces no more than 25% elastomer seal swell; an effective amount of a viscosity index improver; an effective amount of acid control additive; and an effective amount of an erosion inhibitor; wherein the amount of tri-iso-butyl phosphate ranges from about 30 to about 45 weight percent, preferably from about 30 to about 40 weight percent, based on the total weight of the fluid.

In another of its composition aspects, the present invention is directed to an aircraft hydraulic fluid composition comprising a phosphate ester base stock comprising from about 4 to about 14 weight percent, based on the total weight of the hydraulic fluid, of one or more triaryl phosphates, the remainder of the base stock comprising a mixture of tri-iso-butyl phosphate and tri-n-butyl phosphate; an effective amount of a viscosity index improver; an effective amount of acid control additive; and an effective amount of an erosion inhibitor; wherein the amount of tri-iso-butyl phosphate ranges from about 30 to about 45 weight percent, preferably from about 30 to about 40 weight percent, based on the total weight of the fluid.

In still another of its composition aspects, the present invention is directed to an aircraft hydraulic fluid composition comprising:

(a) from about 30 to about 45 weight percent, based on the total weight of the fluid, of tri-iso-butyl phosphate;
(b) from about 30 to about 45 weight percent, based on the total weight of the fluid, of tri-n-butyl phosphate;
(c) from about 10 to about 15 weight percent, based on the total weight of the fluid, of one or more triaryl phosphates;
(d) an effective amount of a viscosity index improver;
(e) an effective amount of acid control additive; and
(f) an effective amount of an erosion inhibitor.

In yet another of its composition aspects, the present invention is directed to an aircraft hydraulic fluid composition comprising:

(a) from about 30 to about 40 weight percent, based on the total weight of the fluid, of tri-iso-butyl phosphate;
(b) from about 35 to about 45 weight percent, based on the total weight of the fluid, of tri-n-butyl phosphate;
(c) from about 10 to about 15 weight percent, based on the total weight of the fluid, of one or more triaryl phosphates;
(d) an effective amount of a viscosity index improver;
(e) an effective amount of acid control additive; and
(f) an effective amount of an erosion inhibitor.

In a preferred embodiment, the above aircraft hydraulic fluids further comprise:

(g) an effective amount of a rust inhibitor or a mixture of rust inhibitors; and
(h) an effective amount of an antioxidant or a mixture of antioxidants.

In yet another of its composition aspects, this invention is directed to a phosphate ester base stock for use in aircraft hydraulic fluids comprising a mixture of tri-iso-butyl phosphate and tri-n-butyl phosphate and a sufficient amount of one or more triaryl phosphates such that the base stock composition produces no more than 25% elastomer seal swell; wherein the amount of tri-iso-butyl phosphate ranges from about 35 to about 50 weight percent, preferably from about 35 to about 45 weight percent, based on the total weight of the base stock.

In another of its composition aspects, this invention is directed to a phosphate ester base stock for use in aircraft hydraulic fluids comprising from about 5 to about 16 weight percent, based on the total weight of the base stock, of one or more triaryl phosphates, the remainder of the base stock comprising a mixture of tri-iso-butyl phosphate and tri-n-butyl phosphate; wherein the amount of tri-iso-butyl phosphate ranges from about 35 to about 50 weight percent, preferably from about 35 to about 45 weight percent, based on the total weight of the base stock.

In still another of its composition aspects, this invention is directed to a phosphate ester base stock for use in aircraft hydraulic fluids comprising:

(a) from about 35 to about 50 weight percent, based on the total weight of the base stock, of tri-iso-butyl phosphate;

(b) from about 35 to about 50 weight percent, based on the total weight of the base stock, of tri-n-butyl phosphate; and (c) from about 6 to about 16 weight percent, based on the total weight of the base stock, of one or more triaryl phosphates.

In yet another of its composition aspects, this invention is directed to a phosphate ester base stock for use in aircraft hydraulic fluids comprising:

(a) from about 35 to about 45 weight percent, based on the total weight of the base stock, of tri-iso-butyl phosphate;

(b) from about 40 to about 50 weight percent, based on the total weight of the base stock, of tri-n-butyl phosphate; and (c) from about 12 to about 16 weight percent, based on the total weight of the base stock, of one or more triaryl phosphates.

Preferably, the phosphate ester base stock comprises from 36 to 44 weight percent of tri-iso-butyl phosphate; from 42 to 48 weight percent of tri-n-butyl phosphate; and from 13 to 15 weight percent of one or more triaryl phosphates, based on the total weight of the base stock.

BRIEF DESCRIPTION OF THE DRAWINGS

FIG. 1 shows a graph of conductivity (in micro mho/cm) versus potassium content (in ppm) for the erosion inhibitor FC-98 in TBP, TIBP and mixed TBP/TIBP solutions.

FIG. 2 shows a graph of conductivity at 20° C. (in micro mho/cm) versus potassium content (in ppm) for the erosion inhibitor FC-95 in TBP, TIBP and mixed TBP/TIBP solutions.

FIG. 5 shows a graph of active acid receptor (in weight percent) versus hours at 250° F. for fully formulated aviation hydraulic fluids containing 0.5% water.

DETAILED DESCRIPTION OF THE INVENTION

Figure 3A:
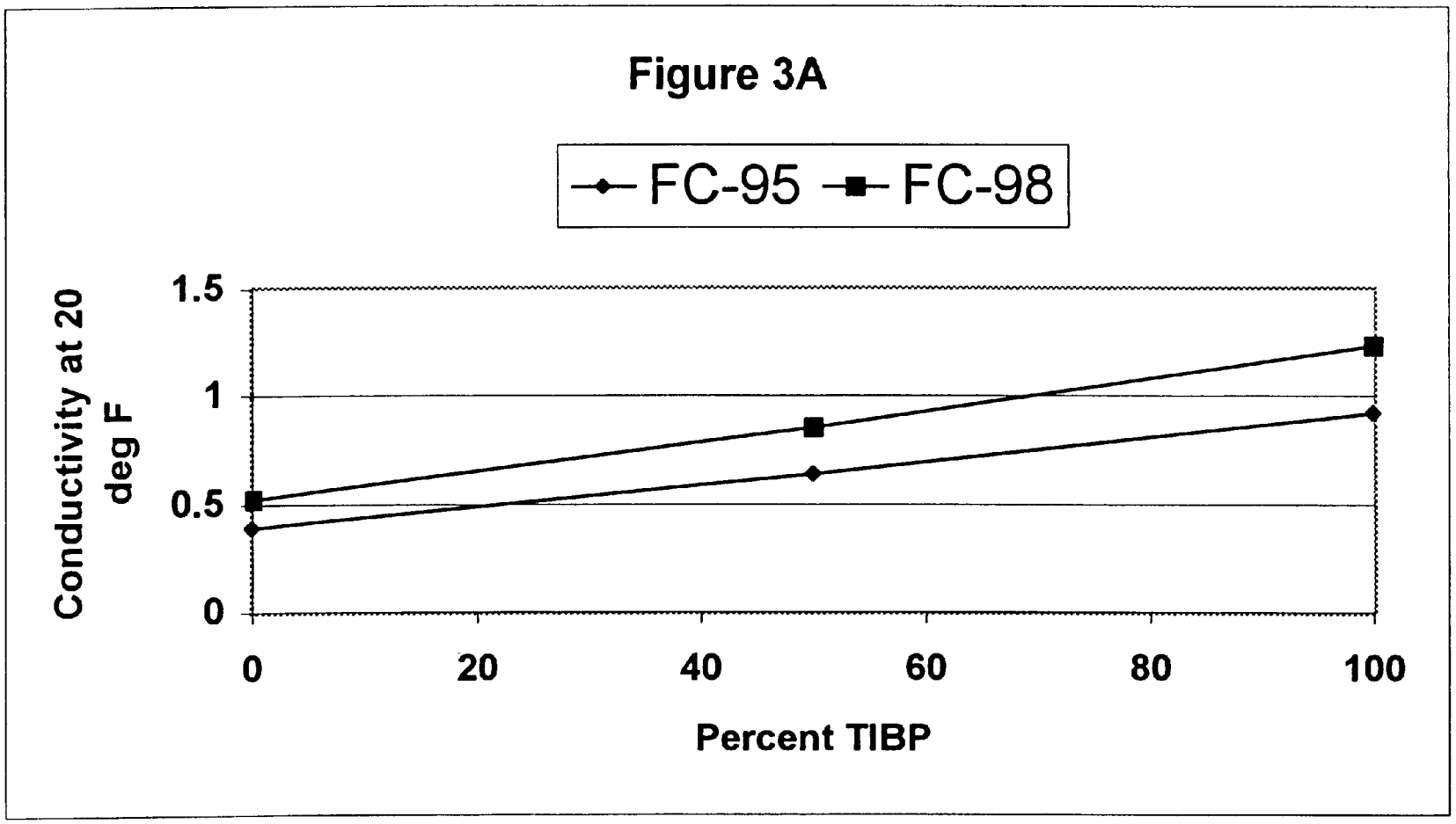
FIG. 3A shows a graph of conductivity at 20° C. (in micro mho/cm) versus percent TIBP for mixed TBP/TIBP solutions containing the erosion inhibitors FC-95 and FC-98.

This invention is directed to novel phosphate ester base stock compositions and to aircraft hydraulic fluid compositions containing such base stocks. The compositions described herein are conventionally prepared by blending the components of the composition together until homogeneous. The blending process may be conducted as a single step process where all of the components are combined and then blended or may be conducted as a multi-step process where two or more of the components are combined and blended and additional components are added to the blended mixture and the resulting mixture further blended.

Preferably, the erosion inhibitor (and optionally the antioxidants that are normally solids) is preblended with at least one of the phosphate ester base stock components [preferably either the TIBP (tri-iso-butyl phosphate) or TBP (tri-n-butyl phosphate), alone or in admixture] to ensure complete dissolution of the erosion inhibitor before addition to the preblend of the remaining additives and phosphate ester component(s).

The phrase "the base stock composition produces no more than 25% elastomer seal swell" means that under industry standard tests, such as NAS-1613 or D6-3614, where a qualified ethylene-propylene elastomer compound is immersed in the aircraft hydraulic fluid and aged for 334 hours at 225° F. (107.2° C.), elastomer seal swell does not exceed 25%.

The term "alkyl" as used herein refers to a monovalent branched or unbranched saturated hydrocarbon group preferably having from 1 to about 12 carbon atoms, more preferably 1 to 8 carbon atoms and still more preferably 1 to 6 carbon atoms. This term is exemplified by groups such as methyl, ethyl, n-propyl, isopropyl, n-butyl, isobutyl, tert-butyl, n-hexyl, n-octyl, tert-octyl, triisopropyl (C9), tetraisopropyl (C12), and the like.

"Cycloalkyl" refers to cyclic alkyl groups of from 3 to 10 carbon atoms having a single cyclic ring or multiple condensed rings which can be optionally substituted with from 1 to 3 alkyl groups. Such cycloalkyl groups include, by way of example, cyclopropyl, cyclobutyl, cyclopentyl, cyclohexyl, cyclooctyl, 1-methylcyclopropyl, 2-methylcyclopentyl, 2-methylcyclooctyl.

"Aryl" refers to an unsaturated aromatic carbocyclic group of from 6 to 14 carbon atoms having a single ring (e.g., phenyl) or multiple condensed rings (e.g., naphthyl). Such aryl groups may be unsubstituted, such as phenyl, naphthyl and the like, or may be substituted with, for example, one or more alkyl groups and preferably 1–2 alkyl groups, including such alkyl aryl groups such as 4-isopropylphenyl, 4-tert-butylphenyl, triisopropylated aryl, tetraisopropylated aryl, and the like.

The phosphate ester base stock composition of this invention comprises a mixture of tri-iso-butyl phosphate and tri-n-butyl phosphate and a sufficient amount of one or more triaryl phosphates such that the base stock composition produces no more than 25% elastomer seal swell.

Preferably, phosphate ester base stock composition of this invention comprises from about 5 to about 16, more preferably from 10 to 16, and still more preferably from 12 to 16 weight percent, based on the total weight of the base stock, of one or more triaryl phosphates, the remainder comprising a mixture of tri-iso-butyl phosphate and tri-n-butyl phosphate.

More preferably, phosphate ester base stock composition of this invention comprises from about 35 to about 50 weight percent, more preferably from about 35 to about 45 weight percent, based on the total weight of the base stock, of tri-iso-butyl phosphate; from about 35 to about 50 weight percent, more preferably from about 40 to about 50 weight percent, based on the total weight of the base stock, of tri-n-butyl phosphate; and from about 6 to 16 weight percent, more preferably from about 12 to about 16 weight percent, based on the total weight of the base stock, of one or more triaryl phosphates. Still more preferably, the phosphate ester base stock comprises from 36 to 44 weight percent, more preferably 39 to 43 weight percent, even more preferably from 40 to 41 weight percent, of tri-iso-butyl phosphate; from 42 to 48 weight percent, preferably 44 to 48 weight percent, more preferably from 45 to 46 weight percent, of tri-n-butyl phosphate; and from 12 to 16 weight percent, more preferably from 13.5 to 14.5 weight percent, of one or more triaryl phosphates, based on the total weight of the base stock.

Preferably, the phosphate ester base stocks of this invention do not contain any triethyl phosphate.

The phosphate ester base stock compositions of this invention may be combined with one or more additives to provide novel aircraft hydraulic fluid compositions. When the phosphate ester base stock is combined with such additives, the hydraulic fluid composition will comprise from about 4 to about 14, more preferably from 8.5 to 14, and still more preferably from 10.5 to 14 weight percent, based on the total weight of the hydraulic fluid, of one or more triaryl phosphates, the remainder comprising a mixture of tri-iso-butyl phosphate and tri-n-butyl phosphate.

More preferably, the hydraulic fluid composition will comprise from about 30 to about 45 weight percent, more preferably from about 30 to about 40 weight percent, based on the total weight of the fluid, of tri-iso-butyl phosphate; from about 30 to about 45 weight percent, more preferably from about 35 to about 45 weight percent, based on the total weight of the fluid, of tri-n-butyl phosphate; and from about 10 to about 15 weight percent, based on the total weight of the fluid, of one or more triaryl phosphates. Preferably, the hydraulic fluid comprises from 34 to 38 weight percent, more preferably from 35 to 36 weight percent, of tri-iso-butyl phosphate; from 38 to 42 weight percent, more preferably from 39.5 to 40.5 weight percent, of tri-n-butyl phosphate; and from 10 to 14 weight percent, more preferably from 11.5 to 12.5 weight percent, of one or more triaryl phosphates, based on the total weight of the hydraulic fluid.

The tri-iso-butyl phosphate and tri-n-butyl phosphate employed in this invention can be prepared using well-known procedures and reagents or are available commercially from, for example, Akzo/Nobel, Bayer, and FMC.

The triaryl phosphate(s) employed in this invention may be any triaryl phosphate suitable for use in aircraft hydraulic fluids including, by way of example, tri(unsubstituted aryl) phosphates, such as triphenyl phosphate; tri(substituted aryl) phosphates, such as tri(alkylated)phenyl phosphates; and triaryl phosphates having a mixture of substituted and unsubstituted aryl groups. Preferably, the triaryl phosphate is a tri(alkylated) aryl phosphate, such as tri(isopropylphenyl) phosphate, tri(tert-butylphenyl) phosphate, tricresyl phosphate and the like. Mixtures of triaryl phosphate can be used in this invention.

A viscosity index (VI) improver is typically employed in the hydraulic fluid compositions of this invention in an amount effective to reduce the effect of temperature on the viscosity of the aircraft hydraulic fluid. Examples of suitable VI improvers are disclosed, for example, in U.S. Pat. No. 5,464,551 and U.S. Pat. No. 3,718,596, the entire disclosures of which are incorporated herein by reference in their entirety. Preferred VI improvers include poly(alkyl acrylate) and poly(alkyl methacrylate) esters of the type disclosed in U.S. Pat. No. 3,718,596, and which are commercially available from Rohm & Haas, Philadelphia, Pa. and others. Such esters typically have a wight average molecular weight range of from about 50,000 to about 1,500,000 and preferably from about 50,000 to 250,000. Preferred VI improvers include those having a molecular weight peak at about 70,000 to 100,000 (e.g., about 85,000 or 90,000 to 100,000). Mixtures of VI improvers can also be used.

The VI improver is employed in an amount effective to reduce the effect of temperature on viscosity, preferably from about 2 to about 10 weight percent (on an active ingredient basis) and more preferably from about 4 to about 6 weight percent based on the total weight of the hydraulic fluid composition. In one embodiment, the VI improver is formulated with a portion of the phosphate ester base stock, typically as a 1:1 mixture.

Typically, the aircraft hydraulic fluid compositions of this invention further comprise an acid control additive or acid scavenger in an amount effective to neutralize acids formed in aircraft hydraulic fluid, such as phosphoric acid and its partial esters. Suitable acid control additives are described, for example, in U.S. Pat. No. 5,464,551; U.S. Pat. No. 3,723,320 and U.S. Pat. No. 4,206,067, the disclosures of which are incorporated herein in their entirety.

Preferred acid control additives have the formula:

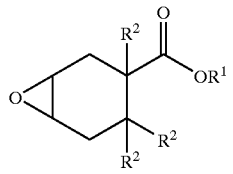

wherein $R^1$ is selected from the group consisting of alkyl of from 1 to 10 carbon atoms, substituted alkyl of from 1 to 10 carbon atoms and from 1 to 4 ether oxygen atoms and cycloalkyl of from 3 to 10 carbon atoms; each $R^2$ is independently selected from the group consisting of hydrogen, alkyl of from 1 to 10 carbon atoms and —C(O)$OR^3$ where $R^3$ is selected from the group consisting of alkyl of from 1 to 10 carbon atoms, substituted alkyl of from 1 to 10 carbon atoms and from 1 to 4 ether oxygen atoms and cycloalkyl of from 3 to 10 carbon atoms.

Particularly preferred acid control additives of the above formula are the monoepoxide, 7-oxabicyclo[4.1.0]heptane-3-carboxylic acid, 2-ethylhexyl ester which is disclosed in U.S. Pat. No. 3,723,320, and the monoepoxide 7-oxabicyclo[4.1.0]-heptane-3,4-dicarboxylic acid, dialkyl esters (e.g., the di-isobutyl ester).

The acid control additive is employed in an amount effective to scavenge the acid generated, typically as partial esters of phosphoric acid, during operation of the power transmission mechanisms of an aircraft. Preferably, the acid control additive is employed in an amount ranging from about 4 to about 10 weight percent, based on the total weight of the hydraulic fluid composition, and more preferably from 4 to 8 weight percent and still more preferably from 5 to 6.5 weight percent.

The hydraulic fluid compositions of this invention also typically comprise an erosion inhibitor in an amount effective to inhibit flow-induced electrochemical corrosion. Suitable erosion inhibitors are disclosed, for example, in U.S. Pat. No. 5,464,551 and U.S. Pat. No. 3,679,587, the entire disclosures of which are incorporated herein by reference in their entirety. Preferred erosion inhibitors include the alkali metal salts, and preferably the potassium salt, of a perfluoroalkyl or perfluorocycloalkyl sulfonate as disclosed in U.S. Pat. No. 3,679,587. Such perfluoroalkyl and perfluorocycloalkyl sulfonates preferably encompass alkyl groups of from 1 to 10 carbon atoms and cycloalkyl groups of from 3 to 10 carbon atoms. Several of these perfluoroalkyl sulfonates are available commercially under the tradenames FC-95, FC-98, and the like, from, for example, 3M, Minneapolis, Minn.

The erosion inhibitor is employed in an amount effective to inhibit erosion in the power transmission mechanisms of an aircraft and, preferably, is employed in an amount of from about 0.01 to about 0.15 weight percent, based on the total weight of the hydraulic fluid composition and more preferably from about 0.05 to about 0.1 weight percent. Mixtures of such anti-erosion agents can be used.

In a preferred embodiment, the hydraulic fluid compositions of this invention further comprise an antioxidant or mixture of antioxidants in an amount effective to inhibit oxidation of the hydraulic fluid or any of its components. Suitable antioxidants are described in U.S. Pat. No. 5,464,551, the entire disclosure of which is incorporated herein by reference in its entirety, and other aircraft hydraulic fluid patents and publications.

Representative antioxidants include, by way of example, phenolic antioxidants, such as 2,6-di-tert-butyl-p-cresol (commonly known as butylated hydroxy toluene or BHT), tetrakis[methylene(3,5-di-tert-butyl4-hydroxyhydrocinnamate)]methane (Irganox® 1010 from Ciba Geigy) and the like; amine antioxidants including, by way of example, diarylamines, such as octylated diphenyl amine (Vanlube® 81 from R. T. Vanderbuilt), phenyl-α-naphthylamine, alkylphenyl-α-naphthylamine, or the reaction product of N-phenylbenzylamine with 2,4,4-trimethylpentene (Irganox® L-57 from Ciba Geigy), diphenylamine, ditolylamine, phenyl tolyamine, 4,4'-diaminodiphenylamine, di-p-methoxydiphenylamine, or 4-cyclohexylaminodiphenylamine. Still other suitable antioxidants include aminophenols such as N-butylaminophenol, N-methyl-N-amylaminophenol and N-isooctyl-p-aminophenol as well as mixtures of any such antioxidants.

A preferred mixture of antioxidants comprises 2,6-di-tert-butyl-p-cresol and di(octylphenyl)amine (e.g., a 1:1 mixture). Another preferred mixture of antioxidants is 2,6-di-tert-butyl-p-cresol, di(octylphenyl)amine and 6-methyl-2,4-bis[(octylthio)-methyl]-phenol (e.g., a 1:2:4 mixture). Still another preferred mixture of antioxidants is 2,6-di-tert-butyl-p-cresol, di(octylphenyl)amine and tetrakis[methylene (3,5-di-tert-butyl-4-hydroxyhydrocinnamate)]methane (e.g., a 1:2:3 mixture).

The antioxidant or mixture of antioxidants is employed in an amount effective to inhibit oxidation of the hydraulic fluid. Preferably, the antioxidant or mixture of antioxidants is employed in an amount ranging from about 0.5 to about 3 weight percent, more preferably from about 0.5 to 2.5 weight percent and still more preferably at from about 1 to 2 weight percent based on the total weight of the hydraulic fluid composition.

In another preferred embodiment, the hydraulic fluid compositions of this invention further comprise a rust inhibitor or a mixture of rust inhibitors in an amount effective to reduce the formation of rust or corrosion on metal surfaces exposed to the hydraulic fluid. Suitable rust inhibitors are described in U.S. Pat. No. 5,464,551, the entire disclosure of which is incorporated herein by reference in its entirety, and other aircraft hydraulic fluid patents and publications.

Representative rust inhibitors include, by way of example, calcium dinonylnaphthalene sulfonate, a Group I or Group II metal overbased and/or sulfurized phenate, a compound of the formula:

$$R^4N[CH_2CH(R^5)OH]_2$$

wherein $R^4$ is selected from the group consisting of alkyl of from 1 to 40 carbon atoms, —$COOR^6$ and —$CH_2CH_2N[CH_2CH(R^5)OH]_2$ where $R^6$ is alkyl of from 1 to 40 carbon atoms, and each $R^5$ is independently selected from the group consisting of hydrogen and methyl, including N,N,N',N'-tetrakis(2-hydroxypropyl) ethylene diamine and N,N-bis(2-hydroxyethyl)tallowamine (e.g., N tallow amine alkyl-2,2'-iminoobisethanol, sold under the tradename Ethomeen T/12).

The Group I and Group II metal overbased and/or sulfurized phenates preferably are either sulfurized Group I or Group II metal phenates (without $CO_2$ added) having a Total Base Number (TBN) of from greater than 0 to about 200 or a Group I or Group II metal overbased sulfurized phenate having a TBN of from 75 to 400 prepared by the addition of carbon dioxide during the preparation of the phenate. More preferably, the metal phenate is a potassium or calcium phenate. Additionally, the phenate advantageously modifies the pH to provide enhanced hydrolytic stability.

Each of these components are either commercially available or can be prepared by art recognized methods. For example, Group II metal overbased sulfurized phenates are commercially available from Chevron Chemical Company, San Ramon, Calif. under the tradename OLOA® including, OLOA 219®, OLOA 216Q® and the like and are described by Campbell, U.S. Pat. No. 5,318,710, and by MacKinnon, U.S. Pat. No. 4,206,067. Likewise, N,N,N',N'-tetrakis(2-hydroxy-propyl)ethylenediamine is disclosed by MacKinnon, U.S. Pat. No. 4,324,674. The disclosures of each of these patents are incorporated herein by reference in their entirety. Group I or II metal dinonylnaphthalene sulfonates, such as calcium dinonylnaphthalene sulfonate and Na-Sul 729 commercially available from King Industries, may also be used as a rust inhibitor in the hydraulic fluid composition in an amount ranging from 0.2 to 1.0 weight percent of the hydraulic fluid composition.

The rust inhibitor or mixture of rust inhibitors is employed in an amount effective to inhibit the formation of rust. Preferably, the rust inhibitor is employed in an amount ranging from about 0.001 to about 1 weight percent, more preferably about 0.005 to about 0.5 weight percent, and still more preferably at about 0.01 to 0.1 weight percent based on the total weight of the hydraulic fluid composition. In a preferred embodiment, the rust inhibitor comprises a mixture of N,N,N',N'-tetrakis(2-hydroxypropyl) ethylenediamine and a Group II metal overbased phenate (e.g., a 5:1 mixture). In another preferred embodiment, the rust inhibitor comprises a mixture of N,N-bis(2-hydroxyethyl)tallowamine (Ethomeen® T/12) and a Group II metal overbased phenate (e.g., a 5:1 mixture).

The hydraulic fluid compositions of this invention can optionally contain further additives such as copper corrosion inhibitors, anti-foaming agents, dyes, etc. Such additives are well-known in the art and are commercially available.

Utility

The phosphate ester base fluids of this invention are useful for preparing aircraft hydraulic fluids and the like. The aircraft hydraulic fluid compositions described herein are useful in aircraft where they operate as a power transmission medium. The components of these phosphate ester base stock and aircraft hydraulic fluid compositions interact synergistically and the selection of the ratio of tri-iso-butyl and tri-n-butyl phosphate content of the fluid is essential to providing an unexpected and surprising balance of combined properties critical to aviation hydraulic oils, including acceptable hydrolytic stability, high flash point, good anti-wear properties, acceptable erosion protection, acceptable low temperature flow properties (viscosity), and elastomer compatibility.

EXAMPLES

Example 1

Formulations of the Invention

The following are examples of formulations of this invention. In these examples, all percents are percents by weight based on the total weight of the composition. Formulation Examples A–D can be prepared by blending the following components:

| | Ex. A | Ex. B | Ex. C | Ex. D |
|---|---|---|---|---|
| TiBP | 35.7% | 34.0% | 37.2% | 36.2% |
| TBP | 39.9% | 41.8% | 38.2% | 39.5% |
| Trialkyl Aryl | 12.1% | 11.9% | 12.3% | 11.8% |
| VI Improver | 5% | 5.1% | 4.9% | 5.2% |
| Acid Control Additive | 5.7% | 5.6% | 5.8% | 5.7% |
| Erosion Inhibitor | 0.07% | 0.05% | 0.06% | 0.05% |
| Rust Inhibitor | 0.01% | 0.03% | 0.02% | 0.03% |
| Antioxidant | 1.5% | 1.5% | 1.3% | 2% |
| Rust Control Additive | 0.05% | 0.05% | 0.07% | — |
| Dyes | 0.0014% | 0.0014% | 0.0014% | 0.0014% |
| Antifoaming Agents | 0.001% | 0.001% | 0.001% | 0.001% |

Example 2

Effect of TIBP Concentration on Conductivity of Trialkyl Phosphate Blends Containing Potassium Perfluoroalkyl Sulfonate Erosion Control Additives Conductivity provided by erosion control additives, in absence of other ionic species in a phosphate ester blend, may be used as an indicator of the effectiveness of an additive designed to control electrochemical erosion. Compositions were prepared using FC-95 and F-98 with TBP and TIBP trialkyl phosphate ester base stocks. These compositions were tested for conductivity and the results are shown in Tables 1 and 2 (and graphically in FIGS. 1 and 2).

TABLE 1

Conductivity Effect of Erosion Inhibitor FC-98 (micro mho/cm at 20° C.)

| Potassium (ppm) | FC-98/TBP | FC-98/TIBP | FC-98/Mixed[1] |
|---|---|---|---|
| 34.40 | 1.01 | | |
| 52.00 | 1.26 | | |
| 65.90 | 1.49 | | |
| 35.40 | | 0.43 | |
| 53.10 | | 0.54 | |
| 68.80 | | 0.64 | |
| 34.80 | | | 0.69 |
| 51.10 | | | 0.86 |
| 66.30 | | | 1.00 |

[1]50 wt. % TBP/50 wt. % TIBP.

TABLE 2

Conductivity Effect of Erosion Inhibitor FC-95 (micro mho/cm at 20° C.)

| Potassium (ppm) | FC-95/TBP | FC-95/TIBP | FC-95/Mixed[1] |
|---|---|---|---|
| 32.20 | 0.72 | | |
| 48.50 | 0.90 | | |
| 63.10 | 1.07 | | |
| 34.60 | | 0.32 | |
| 52.70 | | 0.40 | |
| 68.60 | | 0.47 | |
| 33.80 | | | 0.50 |
| 47.40 | | | 0.62 |
| 66.70 | | | 0.75 |

[1]50 wt. % TBP/50 wt. % TIBP.

The erosion control additives provide higher conductivity as the concentration of TIBP in a TIBP blend with TBP is reduced. Higher conductivity is desirable for better electrochemical erosion control. On the other hand, specific gravity at 25° C./25° C. increases as the concentration of TIBP in a TIBP blend with TBP is reduced. Low specific gravity is preferred, since a lower density phosphate ester aviation hydraulic oil would fill aircraft hydraulic oil systems with lesser total fluid weight, a feature appreciated by aircraft operators. Specific Gravities of TBP and TIBP are 0.975 and 0.964, correspondingly (at the concentrations used, the specific gravity impact of the erosion inhibitor is minimal).

Figure 3B:
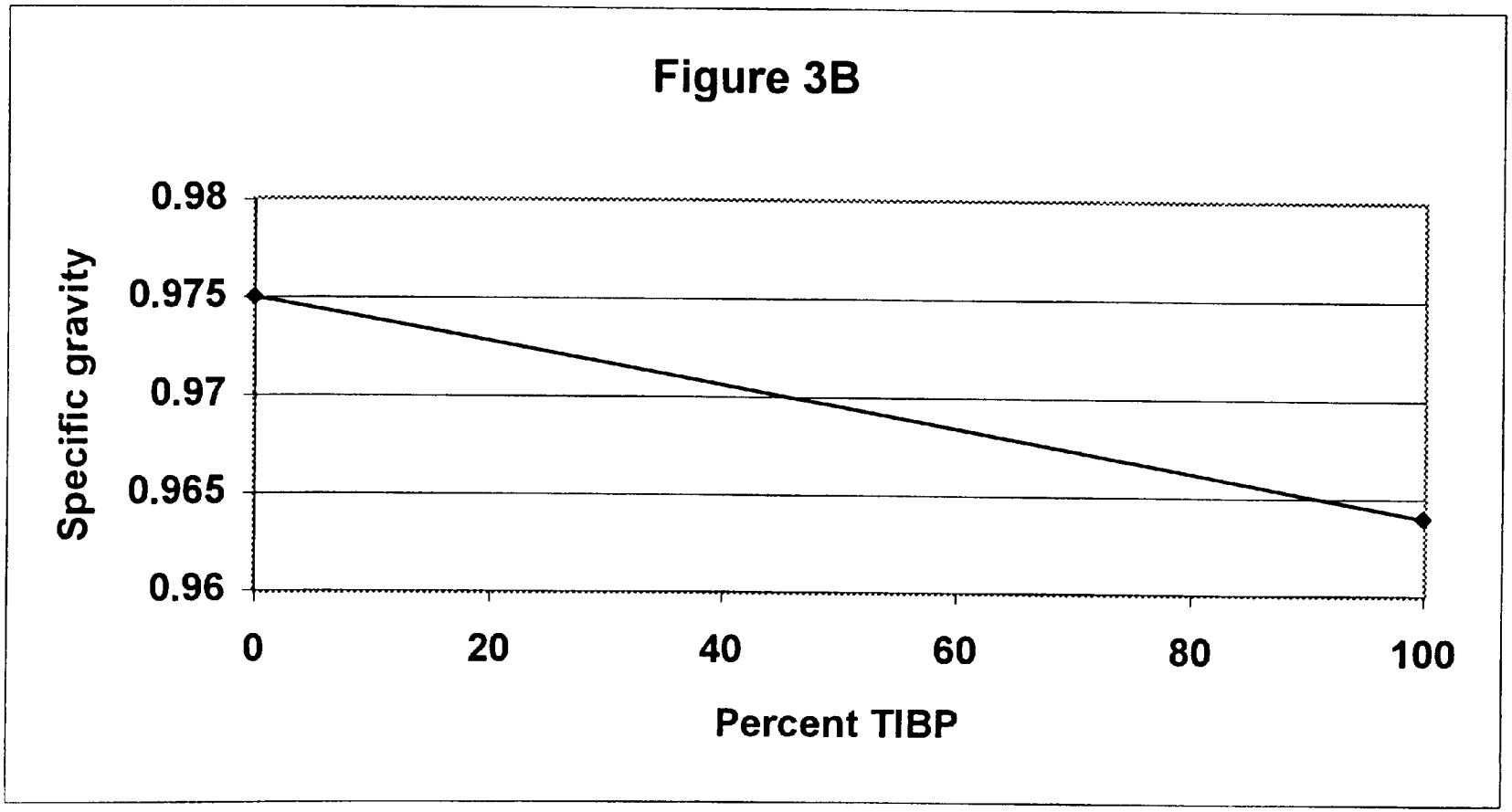
FIG. 3B shows a graph of specific gravity (25° C./25° C.) versus percent TIBP for mixed TBP/TIBP solutions containing the erosion inhibitors FC-95 and FC-98.

Table 3 and FIGS. 3A and 3B show the balance of these two properties at a calculated 50 ppm potassium equivalent concentrations for FC-95 and FC-98. In both cases the optimum balance between conductivity and specific gravity is shown to reside at roughly equal concentrations of TIBP and TBP.

TABLE 3

Trade-Off Between Conductivity and Specific Gravity

| Percent TIBP | FC-95 | FC-98 | Sp Gr |
|---|---|---|---|
| 0 | 0.39 | 0.52 | 0.975 |
| 50 | 0.64 | 0.85 | |
| 100 | 0.92 | 1.23 | 0.964 |

Example 3

Effect of TIBP Concentration on Lubricity and Elastomer Swell

Among properties critical to aviation hydraulic oils, it is important to simultaneously meet good lubricity and low elastomer swell (o-rings aged in phosphate ester lubricant). Testing on compositions shown in Table 4/FIG. 4 indicate that the concentration of TIBP in the trialkyl phosphate composition tends to affect both properties; increased concentration of TIBP deteriorates lubricity as measured by ASTM D 4172 Four-Ball Wear test (measurement of wear scare diameter after 1 hour rotation of steel balls at 75 deg C., 1200 revolutions per minute, and 40 kg applied load) while improving (reducing) swell of qualified ethylene-propylene rubber o-rings exposed to the lubricant compositions (334 hours at 225° F. (107.2° C.)).

Figure 4A:
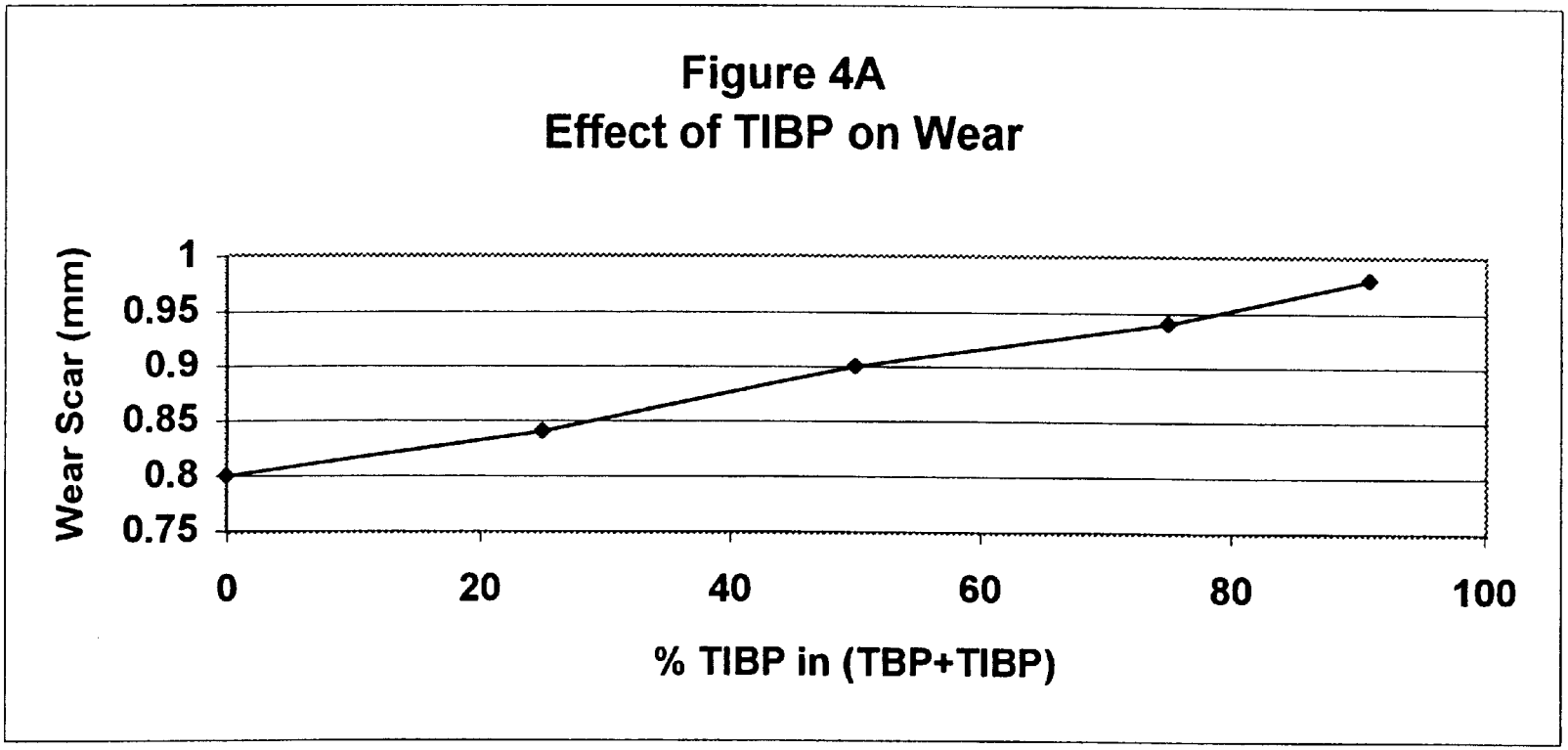
FIG. 4A shows a graph of wear scar (in mm) (by ASTM D4172 Four-Ball Wear Test) versus percent TIBP for mixed TBP/TIBP solutions.
Figure 4B:
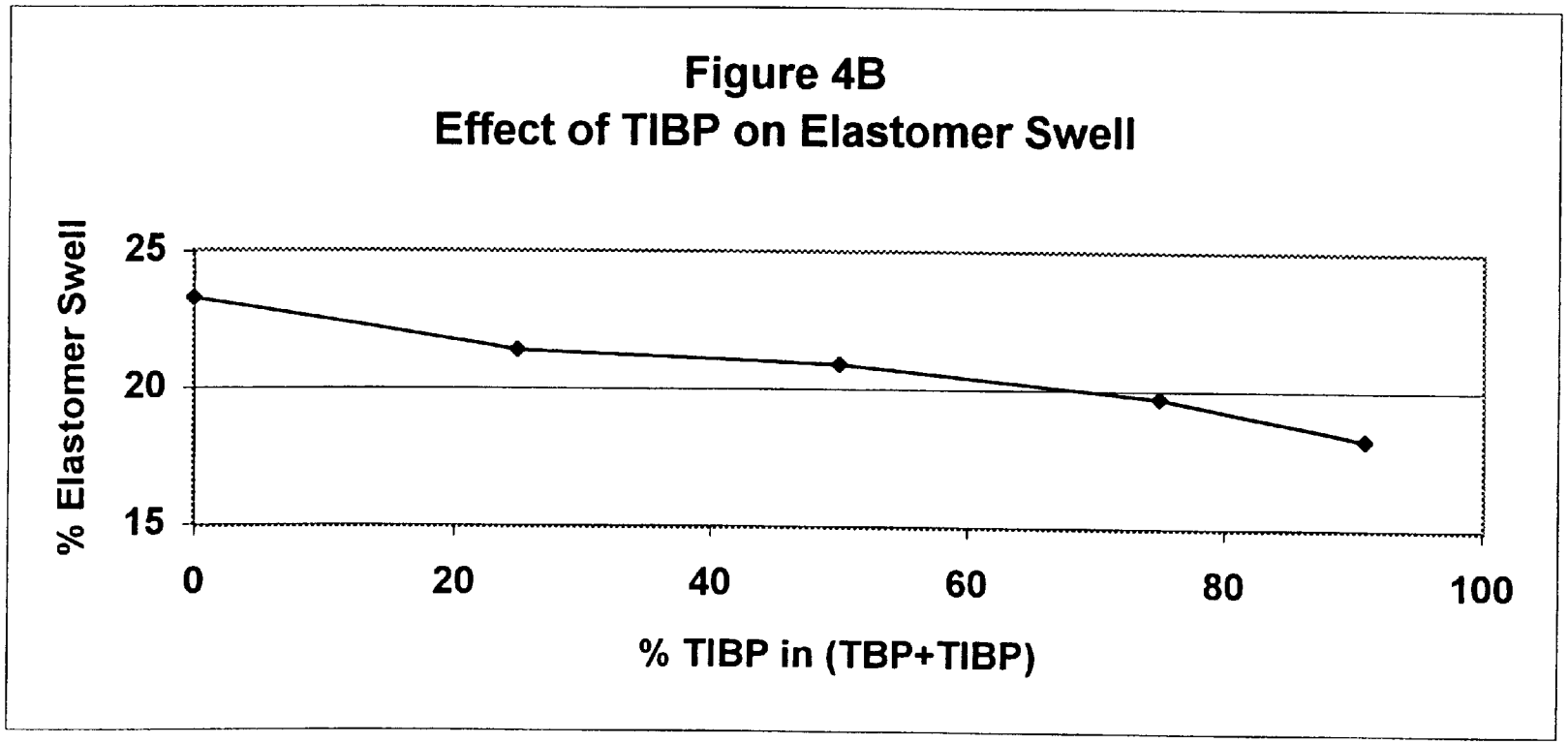
FIG. 4B shows a graph of percent elastomer swell versus percent TIBP for mixed TBP/TIBP solutions.

FIGS. 4A and 4B show that approximately equal concentrations of TBP and TIBP, i.e., ratios of about 3:2 to 2:3 or about 40 wt. % to about 60 wt. % TIBP in (TBP+TIBP), provide a desirable balance between wear performance and seal swell performance.

TABLE 4

Effect of % TIBP in TIBP/TBP Base Stocks on Elastomer Swell and 4-Ball Wear Test Scar Diameter

| | Blend Number | | | | |
|---|---|---|---|---|---|
| Component | 8223 | 8224 | 8225 | 8226 | 8227 |
| % TBP | 80 | 60 | 40 | 20 | 7.5 |
| % TIBP | 0 | 20 | 40 | 60 | 72.5 |
| % Triaryl phosphate | 15 | 15 | 15 | 15 | 15 |
| % VI Improver (Active Ingredient) | 5 | 5 | 5 | 5 | 5 |
| % TIBP in (TBP + TIBP) | 0 | 25 | 50 | 75 | 91 |
| Test Results | | | | | |
| 4-Ball Wear Scar (mm) | 0.8 | 0.84 | 0.9 | 0.94 | 0.98 |
| % Elastomer Swell (334 hrs/225 F.) | 23.3 | 21.4 | 20.9 | 19.7 | 18.2 |

Example 4

Effect of TIBP Concentration on Hydrolytic Stability, Flash Point, and Low Temperature Viscosity Table 5 (and FIG. 5) compare compositions with all ingredients necessary to meet the aviation hydraulic oil specifications imposed by such aircraft manufacturers as Airbus, Boeing, and McDonnell/Douglas. Compositions using substantial amounts of TIBP become borderline in two critical properties, namely flash point and low temperature (−54 deg C.) kinematic viscosity. Low density aviation hydraulic oils are expected to meet a minimum flash point of 160 deg C. (relates to flammability properties of the lubricant) while simultaneously provide good flow properties expressed by a maximum allowed kinematic viscosity of 2000 cSt at −54 deg C. It can be observed that compositions very rich in TIBP (around 68% TIBP/(TBP+TIBP)) are very close to both flash point and low temperature kinematic viscosity limits and would be very hard to manufacture given the variability in properties of raw materials used in manufacturing and testing variability in a commercial plant laboratory. A sufficient cushion for manufacturing can be obtained by restricting the ratio of TIBP/(TBP+TIBP) to about 50% or less. Going to very low concentrations of TIBP in the aviation hydraulic fluid would make adherence to aircraft manufacturer specifications easier, though compositions would come with a weight penalty, as mentioned earlier.

Hydrolysis is the main mechanism by which phosphate ester hydraulic oils degrade in aircraft systems. High concentration of water is commonly encountered in aircraft systems. Rate of reaction with water (hydrolysis which forms acidic species) ultimately sets the life of the lubricant is service (establishes time to replace the oil). Lubricant base stock changes shown in Table 5 have not affected the hydrolytic stability of the lubricant compositions.

TABLE 5

Effect of TIBP Concentration on Hydrolytic Stability, Flash Point and Low Temperature Viscosity

| Component | Blend Number 8117 | 8118 |
|---|---|---|
| TIBP (%) | 51.98 | 34.48 |
| Durad 110[1] (%) | 10.5 | |
| Reolube 140[1] (%) | | 12 |
| TBP (%) | 16.2 | 30.7 |
| TEP (%) | 1.5 | |
| PA 7570[2] (40% active, rest TBP) (%) | 12.5 | 12.5 |
| Monoepoxide[3] (%) | 5.7 | 5.7 |
| Irganox 1010 (%) | 0.75 | 0.75 |
| Vanlube 81 (%) | 0.5 | 0.5 |
| BHT (%) | 0.25 | 0.25 |
| Ethomeen T/12 (%) | 0.05 | 0.05 |
| Dye (%) | 0.0014 | 0.0014 |
| DC 200[4] Antifoam (%) | 0.001 | 0.001 |
| FC-98 (%) | 0.06 | 0.06 |
| OLOA 216Q (%) | 0.01 | 0.01 |
| TIBP/(TBP + TBIP) (%) | 68.6 | 47.4 |
| Test Results | | |
| % Elastomer Swell (70 hours at 70 deg C.) | 11.58 | 11.54 |
| Flash Point (deg C.) | 160 | 171 |
| Specific Gravity (25/25 deg C.) | 0.994 | 0.996 |
| Viscosity at −54 deg C. (cSt) | 1965 | 1816 |
| Active Acid Receptor Content (Oil at 0.5% water, hours aging at 250 deg F.) | | |

TABLE 5-continued

Effect of TIBP Concentration on Hydrolytic Stability, Flash Point and Low Temperature Viscosity

| Component | Blend Number 8117 | 8118 |
|---|---|---|
| Hours | | |
| 0 | 0.333 | 0.336 |
| 48 | 0.29 | 0.278 |
| 96 | 0.253 | 0.198 |
| 144 | 0.132 | |
| 192 | 0.081 | 0.053 |
| 240 | 0.023 | 0.038 |

[1]An isopropylated triphenyl phosphate from FMC.
[2]A polyalkyl methacrylate VI improver from Rohm and Hass.
[3]7-Oxabicyclo[4.1.0]heptane-3-carboxylic acid, 2-ethylhexyl ester.
[4]Silicone from Dow Corning.

Table 6 addresses the option of eliminating triethyl phosphate (TEP) to improve flash point. It can be observed that even though a margin of safety is adding to the fluids ability to meet flash point, this results in a significantly debit in kinematic viscosity at −54 deg C.

TABLE 6

Flash Point and Low Temperature Viscosity Effects

| Component | Blend Number 8148 | 8150 | 8149 |
|---|---|---|---|
| TIBP (%) | 51.98 | 34.48 | 34.48 |
| Durad 110[1] (%) | 10.5 | | |
| Reolube 140[1] (%) | | 12 | 12 |
| TBP (%) | 16.2 | 30.7 | 30.7 |
| TEP (%) | 1.5 | | |
| PA 7570[2] (40% active in TBP) (%) | 12.5 | 12.5 | 12.5 |
| Monoepoxide[3] (%) | 5.7 | 5.7 | 5.7 |
| Irganox 1010 (%) | 0.75 | 0.75 | 0.75 |
| Vanlube 81 (%) | 0.5 | 0.5 | 0.5 |
| BHT (%) | 0.25 | 0.25 | 0.25 |
| Ethomeen T/12 (%) | 0.05 | 0.05 | 0.05 |
| Dye (%) | 0.0014 | 0.0014 | 0.0014 |
| DC 200[4] Antifoam (%) | 0.001 | 0.001 | 0.001 |
| FC-98 (%) | 0.06 | 0.06 | 0.06 |
| OLOA 216Q (%) | 0.01 | 0.01 | 0.01 |
| TIBP/(TBP + TIBP) (%) | 68.6 | 47.4 | 47.7 |
| Test Results | | | |
| Flash Point (deg C.) | 160 | 162 | 169 |
| Viscosity at −54 deg C. (cSt) | 1950 | 2425 | 1760 |

[1]An isopropylated triphenyl phosphate from FMC.
[2]A polyalkyl methacrylate VI improver from Rohm and Hass.
[3]7-Oxabicyclo[4.1.0]heptane-3-carboxylic acid, 2-ethylhexyl ester.
[4]Silicone from Dow Corning.

What is claimed is:

1. A phosphate ester base stock for use in aircraft hydraulic fluids comprising a mixture of tri-iso-butyl phosphate and tri-n-butyl phosphate and a sufficient amount of one or more triaryl phosphates such that the base stock composition produces no more than 25% elastomer seal swell; wherein the amount of tri-iso-butyl phosphate ranges from about 35 to about 50 weight percent based on the total weight of the base stock.

2. The phosphate ester base stock of claim 1, wherein the amount of tri-iso-butyl phosphate ranges from about 35 to about 45 weight percent, based on the total weight of the base stock.

3. A phosphate ester base stock for use in aircraft hydraulic fluids comprising from about 5 to about 16 weight percent, based on the total weight of the base stock, of one or more triaryl phosphates, the remainder of the base stock comprising a mixture of tri-iso-butyl phosphate and tri-n-butyl phosphate; wherein the amount of tri-iso-butyl phosphate ranges from about 35 to about 50 weight percent based on the total weight of the base stock.

4. The phosphate ester base stock of claim 3, wherein the amount of tri-iso-butyl phosphate ranges from about 35 to about 45 weight percent based on the total weight of the base stock.

5. A phosphate ester base stock for use in aircraft hydraulic fluids comprising:

(a) from about 35 to about 50 weight percent, based on the total weight of the base stock, of tri-iso-butyl phosphate;

(b) from about 35 to about 50 weight percent, based on the total weight of the base stock, of tri-n-butyl phosphate; and (c) from about 12 to about 16 weight percent, based on the total weight of the base stock, of one or more triaryl phosphates.

6. The phosphate ester base stock of claim 5, wherein the amount of tri-iso-butyl phosphate ranges from about 30 to about 45 weight percent, and the amount of tri-n-butyl phosphate ranges from about 40 to about 50 weight percent based on the total weight of the base stock.

7. The phosphate ester base stock of claim 5 comprising from 36 to 44 weight percent, based on the weight of the base stock, of tri-iso-butyl phosphate.

8. The phosphate ester base stock of claim 7 comprising from 42 to 48 weight percent, based on the weight of the base stock, of tri-n-butyl phosphate.

9. The phosphate ester base stock of claim 8 comprising from 13 to 15 weight percent, based on the weight of the base stock, of one or more triaryl phosphates.

* * * * *